US006287079B1

(12) United States Patent
Gosling et al.

(10) Patent No.: US 6,287,079 B1
(45) Date of Patent: Sep. 11, 2001

(54) SHEAR PIN WITH LOCKING CAM

(75) Inventors: Martin Charles Gosling, Hamilton; Kevin Moles, Stoney Creek; R. C. Chune, Guelph, all of (CA)

(73) Assignee: Siemens Westinghouse Power Corporation, Orlando, FL (US)

( * ) Notice: Subject to any disclaimer, the term of this patent is extended or adjusted under 35 U.S.C. 154(b) by 0 days.

(21) Appl. No.: 09/454,777

(22) Filed: Dec. 3, 1999

(51) Int. Cl.[7] ..... B63H 1/20
(52) U.S. Cl. ..... 416/220 R; 416/248
(58) Field of Search ..... 416/198 A, 201 R, 416/244 A, 244 R, 248, 2, 221; 415/9

(56) References Cited

U.S. PATENT DOCUMENTS 2,753,149 7/1956 Kurti .
4,050,850 * 9/1977 Beckershoff ..... 416/221
4,400,137 * 8/1983 Miller et al. ..... 416/220 R
5,720,596 * 2/1998 Pepperman ..... 416/220 R
5,727,927 3/1998 Luxenburger .
5,749,706 5/1998 Maar .

* cited by examiner

*Primary Examiner*—Edward K. Look
*Assistant Examiner*—James M McAleenan

(57) ABSTRACT

A shear pin assembly to be used in a blind radial hole on a rotor assembly stack. The blind radial hole is located at the interface between the disks that form the rotor stack and has a slot cut into one of the disks. The shear pin is disposed in the blind radial hole and includes, a cylindrical body, a cavity, and a cam pivotally disposed in said cavity. When the shear pin is installed, the cam is pivoted into the slot, locking the pin in the blind radial hole.

18 Claims, 4 Drawing Sheets

SHEAR PIN WITH LOCKING CAM

BACKGROUND OF THE INVENTION

1. Field of the Invention

This invention relates to rotors for compressors and turbines and, more specifically, to shear pins mounted between the disks which form the rotor.

2. Background Information

The hub of a compressor or turbine rotor is comprised of a plurality of stacked disks. Each disk provides a means for attaching a plurality of blades. The combination of blades and disks form the bulk of the rotor. The disks are situated one next to another forming a stack with an interface between each pair of disks. The disks may be attached to each other by various means such as a threaded fastener passing axially through each disk. Such fasteners hold the disks axially and assist in creating friction at each interface between the disks. The friction at the interface between each disk transmits engine torque throughout the rotor stack. Additionally, it is known to provide radial shear pins at each disk interface to assist in transmitting engine torque.

Prior art shear pins included a pin body with an expanded portion at both ends. The pins were positioned in holes bored into the rotor stack. The holes extend between the outer surface of the rotor stack and a cavity which is formed between each pair of disks. The holes are counter-bored on each end. Thus, after a pin was installed in a hole, the expanded ends of the pin fit into the counter-bores, preventing the pins from moving radially and securing the pins within the holes during operation or the rotor.

The installation of the prior art shear pins was a time consuming operation. The process entailed a total of two disk stacking and one de-stacking operations. The first stacking operation was required to position the disks to allow the holes to be bored at the interface between each disk. After the holes were bored, the ends were counter-bored, and back counter-bored. Because the pin holes extended into an inner cavity in the rotor, debris from the drilling operation fell into the cavity. The rotor had to be de-stacked to allow removal of the cutting debris and to allow placement of the pins between each rotor disk. Additionally, the bore holes needed to be cleaned and de-burred prior to insertion of the pins between the disks. As each disk was being re-stacked, a plurality of pins were set, one each, in the bore holes on the exposed interface. As the next disk in the stack was put in place, the pins became trapped in the bore holes by virtue of the expanded ends.

There is, therefore, a need for a rotor shear pin that may be installed without requiring the rotor stack to be de-stacked.

There is a further need for a rotor shear pin that may be installed in a blind pin hole.

SUMMARY OF THE INVENTION

These needs and others are satisfied by the present invention which relates to a shear pin having a pivoting cam. The shear pin includes a cylindrical body having a cavity located adjacent to the upper end of the shear pin. A cam is pivotally disposed within the cavity. The shear pin further includes a hole passing through the upper end and into the cavity. As the shear pin is being inserted in its hole the cam is positioned entirely within the cavity. Once the shear pin is in place, the cam is rotated so that a portion of the cam engages the slot in the rotor disk. The cam is held in the slot by the self-locking fastener which is inserted in the hole in the upper end of the shear pin. The cam holds the shear pin in place by cooperating with a slot that is machined into a rotor disk.

The assembly of the rotor using the shear pins of the present invention can be accomplished without de-stacking the rotor. To assembly the rotor, the disks are stacked, the holes and slots are machined, cleaned and de-burred, and the shear pins installed in the holes. Because shear pins of the present invention do not require a hole that is drilled into the inner cavity of the rotor stack there is no opportunity for debris to enter the cavity. Accordingly, the bore holes for shear pins of the present invention can be cleaned and de-burred without the rotor being de-stacked.

BRIEF DESCRIPTION OF THE DRAWINGS

A full understanding of the invention can be gained from the following description of the preferred embodiments when read in conjunction with the accompanying drawings in which:

FIG. 5 is a schematic view of the self-locking screw. Specifically.

DESCRIPTION OF THE PREFERRED EMBODIMENT

Figure 1:
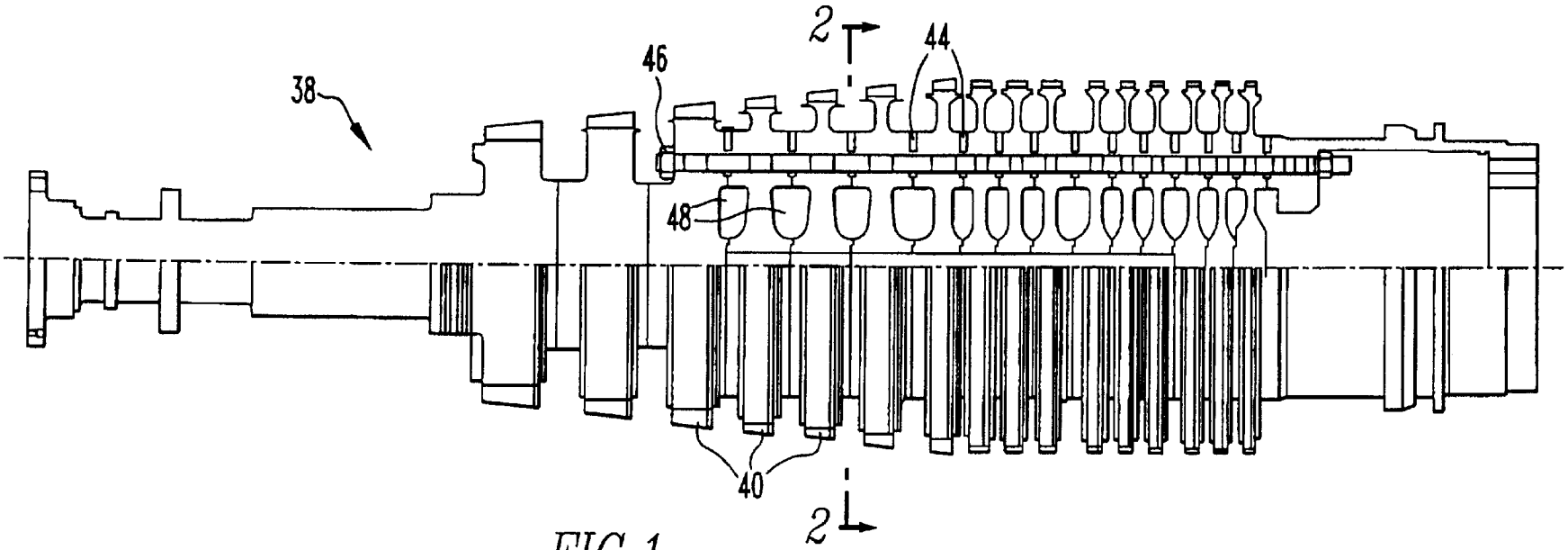
FIG. 1 is a partial cross sectional view of a rotor incorporating shear pins according to the present invention.
Figure 2:
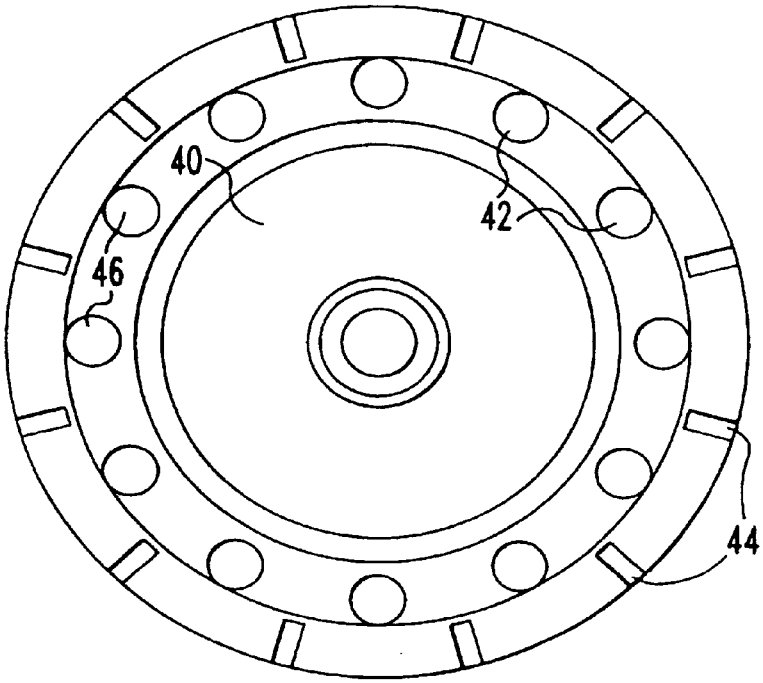
FIG. 2 is a view taken along line 2—2 of FIG. 1.
Figure 3:
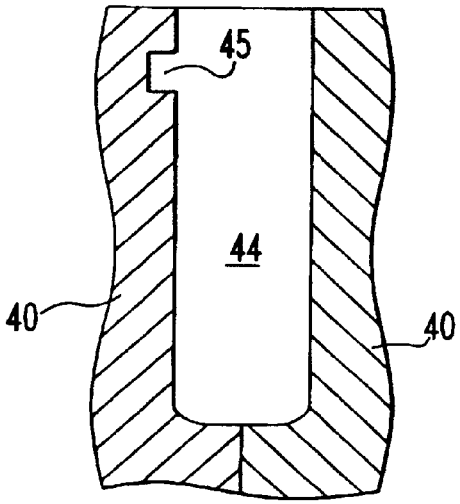
FIG. 3 is a detail of a shear pin hole.

FIG. 1 shows a rotor stack 38 which incorporates shear pin assemblies 10 of the present invention. The rotor stack 38, which is well known in the prior art, is comprised of a series of compressor disks 40. As shown in FIG. 2, each compressor disk 40 includes a plurality of axial holes 42 and blind radial holes 44. As shown on FIG. 1, a fastener 46 extends through each axial hole 42 providing axial support for the rotor stack 38. Each radial hole 44 is located on an interface between adjacent disks 40. The plane of the interface between the disks 40 bisects the radial holes. As shown on FIG. 3, each radial hole 44 includes a slot 45. To avoid stress on the shear pin 10 caused by thermal differences between the disks 40, the slot 45 is, preferably, machined into a single compressor disk 40. The slot 45 cooperates with the locking cam 18 of the shear pin assembly 10 (described below).

When initially assembled, the rotor stack 38 does not have radial holes 44 or slots 45. The disks 40 are assembled into the rotor 38 by placing the disks in series. Blind radial holes 44 and slots 45 are machined into each interface between disks 40. The plane defining the interface between each pair of disks 40 bisects each blind radial hole 44. Each slot 45 is machined into a single disk 40. The blind radial holes 44 do not extend into the inner cavity 48 between the disks 40. After machining each blind radial hole 44 and slot 45, each is cleaned and de-burred.

Figure 4:
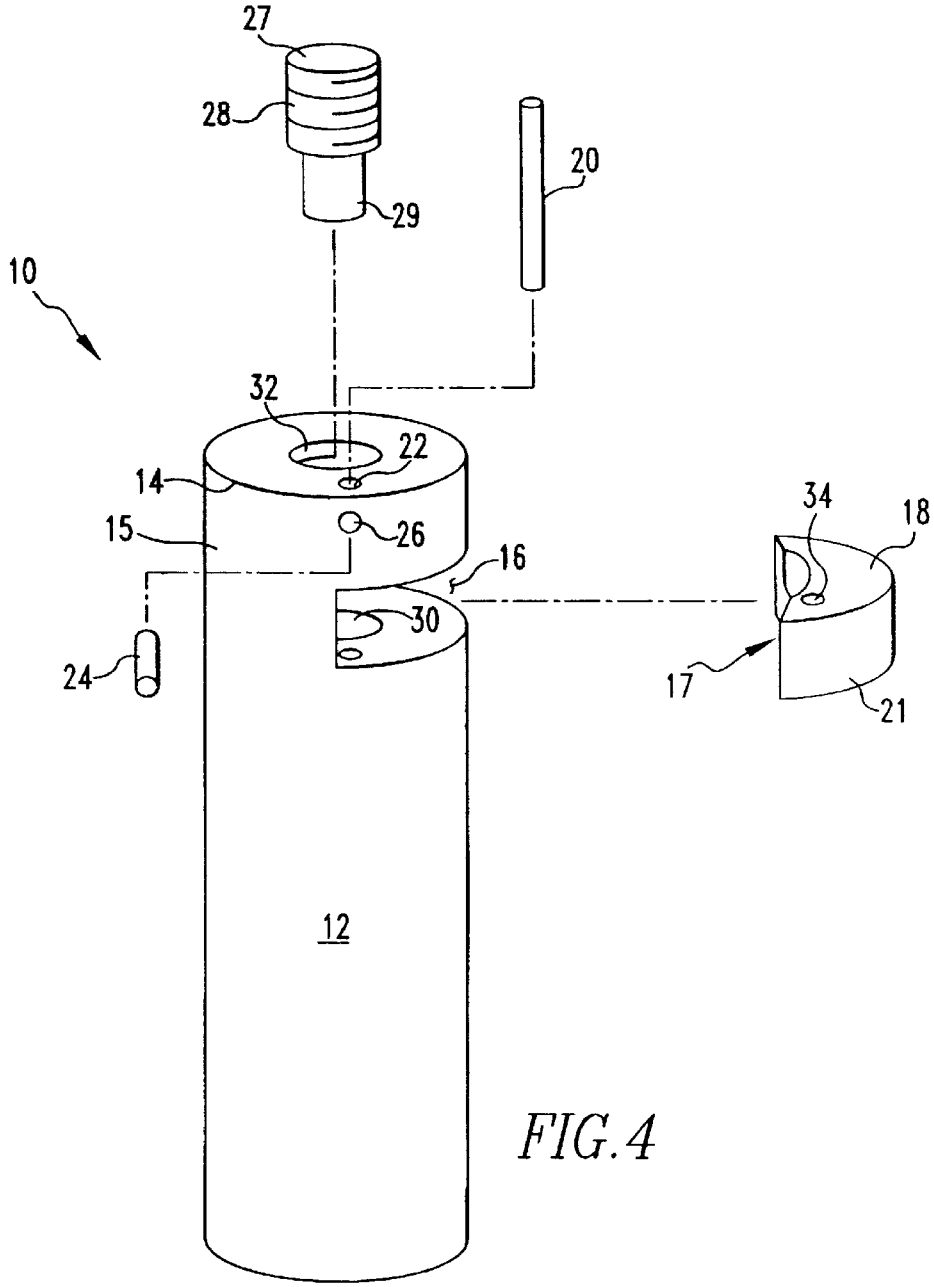
FIG. 4 is an exploded view of a shear pin assembly according to the present invention.
Figure 5A:
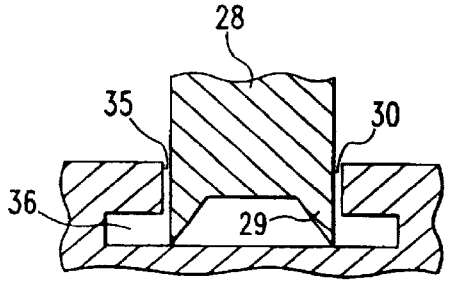
FIG. 5*a* is a view of the self-locking screw prior to engagement and FIG. 5B is a view of the self-locking screw after engagement.
Figure 5B:
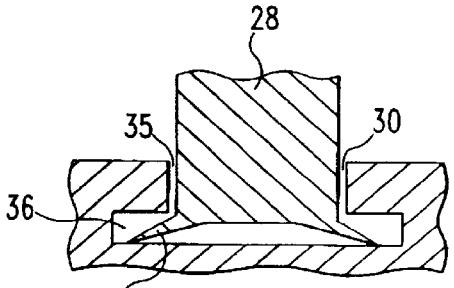
Figure 6:
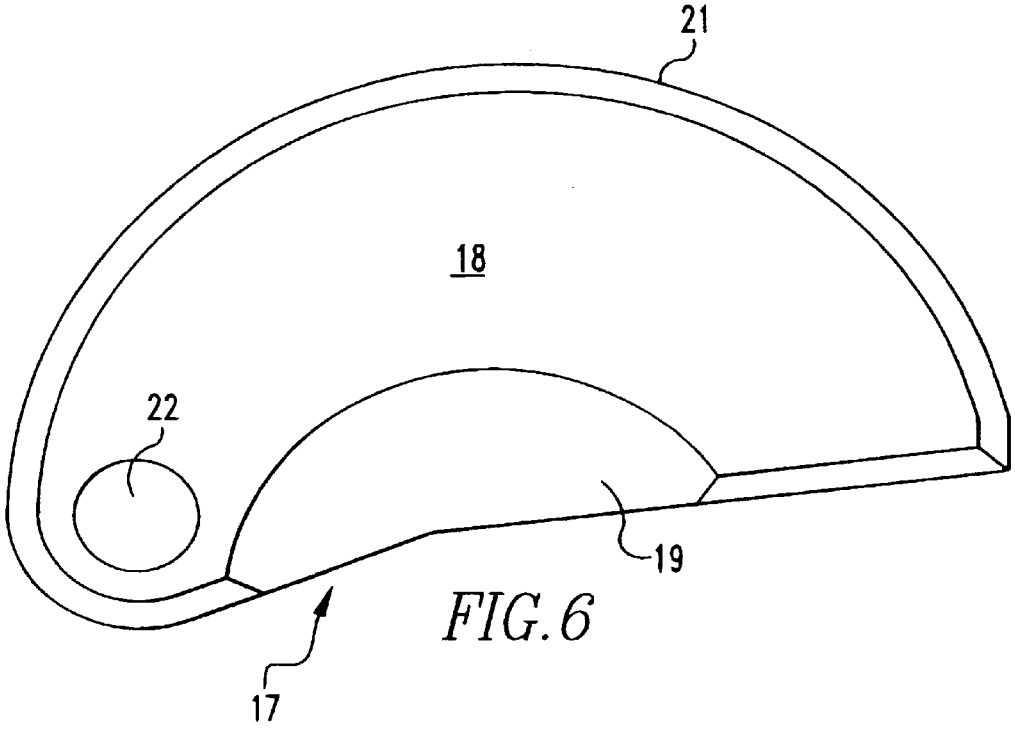
FIG. 6 is a top view of the cam.
Figure 7:
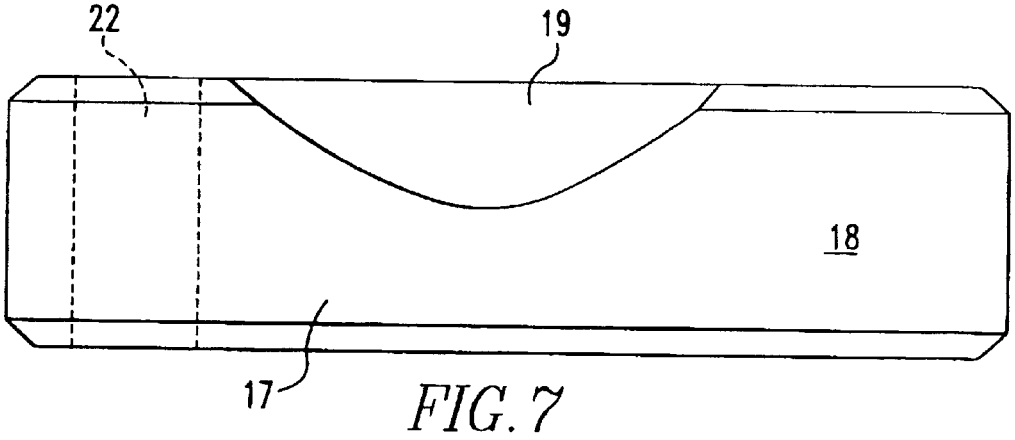
FIG. 7 is a side view of the cam.

As shown in FIG. 4, the shear pin assembly 10 includes a cylindrical pin body 12, and upper end 14, and upper portion 15, a cavity 16 in the pin body upper portion 15, a cam 18 pivotally disposed in the cavity 16, a pivot pin 20, a pivot pin hole 22, a cross pin 24, a cross pin hole 26, a self-locking screw 28, and a self-locking screw recess 30. The upper end 14 of the pin has a threaded opening 32 communicating with the cavity 16 and aligned with the self-locking screw recess 30. As shown in FIGS. 4, 6 and 7, the cam 18 has a semi-circular body which has a generally straight edge 17 and a curved edge 21, and further includes a pivot pin hole 34. The generally straight edge 17 includes a conical depression 19. Cross pin hole 26 is perpendicular to and communicates with pivot pin hole 22. Self-locking screw 28 includes a deformable end 29. As shown on FIGS. 5*a* and 5*b,* the self-locking screw recess 30 is cylindrical and has a narrow portion 35 and a wide portion 36. Narrow portion 35 is generally the same diameter as the undeformed deformable end 29 of self-locking screw 28. Wide portion 36 has a greater diameter than the undeformed deformable end 29 of self-locking screw 28.

When shear pin assembly 10 is assembled, cam 18 is pivotally disposed within cavity 16, and pivot pin 20 is disposed within pivot pin hole 22 and cam pivot pin hole 34. Cam 18 pivots about pivot pin 20. Cross pin 24 is disposed in cross pin hole 26, which is located above the top of pivot pin 20. Thus, pivot pin 20 is secured in pivot pin hole 22 and cam pivot pin hole 34. Screw 28 may be disposed within threaded opening 32, but the self-locking feature is not engaged and the screw 28 does not pass into cavity 16.

A shear pin assembly 10 is inserted into each blind radial hole 44 in rotor stack 38. As the shear pin assembly 10 is being inserted into the blind radial hole 44, the cam 18 is disposed entirely within cavity 16. Typically, the rotor stack 38 is positioned so that the plane defining the interface between adjacent disks 40 is horizontal. With the rotor stack 38 in such an orientation, and after the shear pin assembly 10 is inserted in blind radial hole 44, cam 18 may be aligned with slot 45. When the cam 18 and the slot 45 are aligned, cam 18 is pivoted into slot 45, preferably by gravity. Alternatively, if the cam 18 does not rotate under the influence of gravity, the insertion of screw 28 in threaded hole 32 will cause screw end 29 to contact conical depression 19 which will affect the rotation of cam 18 into slot 45. Alternatively, with screw 28 removed from threaded hole 32, a tool may be inserted through threaded hole 32 to rotate cam 18 into slot 45. Screw 28, is inserted within threaded hole 32 and tightened, passing into cavity 16 thereby preventing cam 18 from pivoting back into cavity 16. As shown on FIGS. 5*a* and 5*b,* as screw 28 is tightened, deformable end 29 engages the self-locking recess 30. As deformable end 29 is flattened in self-locking screw recess 30, the deformable end becomes wider and expands into the wide portion 36 of the recess 30, thus locking screw 28 in place. When screw 28 is installed, the top surface of screw 28 is approximately flush with upper end 14. A shear pin assembly 10 is installed in each blind radial hole 44 in the rotor stack 38.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A shear pin assembly to be used in a rotor assembly formed from a plurality of disks stacked in tandem, said disks forming at least one blind radial hole at an interface between said disks, said at least one blind radial hole having a slot extending into one said disk, said shear pin disposed in said blind radial hole between said disks, said shear pin assembly comprising:

a cylindrical body having a cavity;

a cam pivotally disposed in said cavity.

2. The shear pin assembly of claim 1, wherein said assembly further includes:

a pivot pin;

said body having a pivot pin hole extending from said top end, into said cavity;

said cam having a pivot pin hole;

said pivot pin disposed in said body pivot pin hole and said cam pivot pin hole.

3. The shear pin assembly of claim 2, wherein said assembly further includes:

a self-locking screw;

said body having an upper end with a medial opening therethrough communicating with said cavity said self-locking screw disposed in said medial hole.

4. The shear pin assembly of claim 3, wherein said self-locking screw has a deformable base;

said cavity includes a self-locking screw recess;

said deformable base coupleable to said self-locking screw recess when said self-locking screw is tightened in said shear pin.

5. The shear pin assembly of claim 4, wherein said assembly further includes:

a cross pin;

said body having a cross pin hole extending perpendicular to and communicating with said pivot pin hole;

said cross pin disposed in said cross pin hole.

6. A rotor assembly comprising:

a plurality of disks;

an attachment means for attaching said disks in series;

at least one radial cylindrical blind shear pin hole located at an interface between two said disks;

said blind shear pin hole having a slot extending into said disk;

a shear pin assembly comprising:

a cylindrical body having a cavity;

a cam pivotally disposed in said cavity;

said shear pin disposed in said blind shear pin hole;

said cam engaging said slot.

7. The rotor assembly of claim 6, wherein said shear pin assembly further includes:

a pivot pin;

said body having a pivot pin hole extending from said top end, into said cavity;

said cam having a pivot pin hole;

said pivot pin disposed in said body pivot pin hole and said cam pivot pin hole.

8. The rotor assembly of claim 7, wherein said hear pin assembly further includes:

a self-locking screw;

said pin body having an upper end with a medial opening therethrough communicating with said cavity;

said self-locking screw disposed in said medial hole.

9. The rotor assembly of claim 8, wherein said self-locking screw has a deformable base;

said cavity includes a self-locking screw recess;

said deformable base coupleable to said self-locking screw recess when said self-locking screw is tightened in said shear pin.

10. The rotor assembly of claim 9, wherein said shear pin assembly further includes:

a cross pin;

said body having a cross pin hole extending perpendicular to and communicating with said pivot pin hole;

said cross pin disposed in said cross pin hole.

11. A turbine assembly comprising:

at least one rotor assembly comprising:

a plurality of disks;

an attachment means for attaching said disks in series;

at least one radial cylindrical blind shear pin hole located at an interface between two said disks;

said blind shear pin hole having a slot extending into said disk;

a shear pin assembly comprising:

a cylindrical body having a cavity;

a cam pivotally disposed in said cavity;

said shear pin disposed in said blind shear pin hole;

said cam engaging said slot.

12. The turbine assembly of claim 11, wherein said shear pin assembly further includes:

a pivot pin;

said body having a pivot pin hole extending from said top end, into said cavity;

said cam having a pivot pin hole;

said pivot pin disposed in said body pivot pin hole and said cam pivot pin hole.

13. The turbine assembly of claim 12, wherein said shear pin assembly further includes:

a self-locking screw;

said pin body having an upper end with a medial opening therethrough communicating with said cavity;

said self-locking screw disposed in said medial hole.

14. The turbine assembly of claim 13, wherein said self-locking screw has a deformable base;

said cavity includes a self-locking screw recess;

said deformable base coupleable to said self-locking screw recess when said self-locking screw is tightened in said shear pin.

15. The turbine assembly of claim 14, wherein said shear pin assembly further includes:

a cross pin;

said body having a cross pin hole extending perpendicular to and communicating with said pivot pin hole;

said cross pin disposed in said cross pin hole.

16. A method of assembling a compressor rotor comprising the steps of:

(a) providing a plurality of shear pin assemblies comprising:

a cylindrical body having a top end and a bottom end;

said body having a cavity adjacent to said top end and a medial opening communicating between said top end and said cavity;

a cam pivotally disposed in said cavity;

(b) providing a plurality of disks;

(c) stacking said plurality of disks;

(d) attaching each said stacked disk to an adjacent disk forming a rotor stack;

(e) machining a plurality of blind radial holes, at least one blind radial hole at each interface between said disks;

(f) machining a slot in each blind radial hole, said slot located within a single disk;

(g) cleaning each said blind radial hole and slot;

(h) inserting said shear pin assemblies into said blind holes;

(i) rotating said cams into said slots;

(j) locking said cams in place.

17. The method of claim 16 comprising the further steps of:

(k) installing a self-locking screw in each said pin top end hole;

(l) tightening each said self-locking screw so that each said screw passes into said cavity and prevents said cam from rotating back into said cavity.

18. The method of claim 16, wherein gravity rotates said cams into said slots.

* * * * *